United States Patent [19]

Strauss

[11] 4,223,474

[45] Sep. 23, 1980

[54] INFLATABLE NURSERY TOY

[75] Inventor: Manfred Strauss, Randolph, N.J.

[73] Assignee: Shelcore, Inc., New York, N.Y.

[21] Appl. No.: 40,498

[22] Filed: May 21, 1979

[51] Int. Cl.[3] ..... A63H 3/06

[52] U.S. Cl. ..... 46/87; 273/58 F

[58] Field of Search ..... 46/87, 88, 90, 1 R; 273/58 F, 58 R, 58 B; 272/1 R, 1 E

[56] References Cited

U.S. PATENT DOCUMENTS

| | | | |
|---|---|---|---|
| 2,859,968 | 11/1958 | Modica | 273/58 F |
| 3,633,587 | 1/1972 | Hunt | 46/175 |
| 3,954,269 | 5/1976 | Brittingham | 273/58 F |

*Primary Examiner*—Robert A. Hafer

*Attorney, Agent, or Firm*—Kirschstein, Kirschstein, Ottinger & Cobrin

[57] ABSTRACT

An inflatable nursery toy typically consisting of a large generally barrel-shaped inflatable outer bag composed of soft, limp, flexible and non-resilient sheet material such as plastic, with donut-shaped cuffs at either end thereof. A smaller, separately inflatable cylindrical tube, usually composed of the same plastic material as the outer tube, is located within the barrel and is inclined lengthwise of the barrel relative to the axis of symmetry thereof. A plurality of balls are located within the cylindrical tube, and these balls travel lengthwise due to gravity, as a child rolls the barrel along the floor.

15 Claims, 6 Drawing Figures

INFLATABLE NURSERY TOY

BACKGROUND OF THE INVENTION

1. Field of the Invention

This invention relates to an inflatable toy.

2. Description of the Prior Art

Inflatable toys of the type to which this invention relates are bags of limp non-resilient synthetic plastic sheet material having an opening into which a gas such as air under a mild pressure can be introduced and the opening then closed to maintain the bag in a blown up state. The bag is shaped to impart a predetermined three-dimensioned configuration thereto when inflated. Such toys are well known. Inflatable toys of the prior art have mostly related to water sports. Other such toys have constituted balls, punching bags and animal and humanoid figures.

Among the abundance of prior art relative to inflatable toys and the like may be mentioned U.S. Pat. Nos. 3,758,981; 3,676,276; 3,664,290; 3,633,587; 3,378,948; 3,204,964; 3,180,639; 3,163,419; 2,938,727; 2,804,123; 2,193,069; 2,027,225; 1,951,193; 1,928,703; 1,471,886; 1,283,095 and 291,015; U.S. Pat. Nos. De. 216,012; 169,631 and 162,022; the Sears Roebuck catalogue, 1973, p. 480, FIG. G "Toddle Roller" and the Sears Roebuck catalogue, 1974, "Toddle Roller".

SUMMARY OF THE INVENTION

1. Purposes of the Invention

It is an object of the present invention to provide a toy which can serve as a walking aid for a young child.

It is another object of the invention to provide a toy which is light enough for a child to manipulate but sturdy enough to support a child when it attempts to stand or to walk.

Another object of the invention is to provide a toy which has large surfaces for the imprinting of educational material in the form of figures, letters, colors, and animals for teaching a child.

It is another object of the invention to provide a toy which can be used in connection with water sports for young children.

It is another object of the invention to provide a toy which generates sound when played with.

It is another object of the invention to provide a toy for visually training children.

It is another object of the invention to provide a toys which allows children to observe the motion of spheres when they are subjected to external forces.

It is another object of the invention to provide a toy that will acquaint children with the transparent properties of windows.

It is another object of the invention to provide children with an analogue of a television screen.

It is another object of the invention to provide a toy to teach children the difference between a sphere and a cylinder with respect to their rolling properties.

It is another object of the invention to provide a light weight soft educational toy which can be handled easily by children and which can be safely thrown without harm.

It is another object of the invention to provide a toy capable of telling a picture story to a child.

It is another object of the invention to provide a toy which is durable and resistant to abuse.

It is another object of the invention to provide a toy of which a child can observe both the inside and the outside.

It is another object of the invention to provide a toy with which a child can learn to distinguish the difference between stable and labile equilibrium.

It is another object of the invention to provide a toy which contains in its interesting interior articles that can be observed through windows from the outside together with the reaction to any forces and motion applied to the toy from the outside.

It is another object of the invention to provide a toy which is interesting and can be used as a seat for a child.

It is another object of the invention to provide a toy with which a child can observe the properties of stable and of labile equilibrium.

These and other objects and advantages of the present invention will become evident from the description which follows.

2. Brief Description of the Invention

The present invention is directed to a toy shaped like a barrel or cylinder. The toy is suitable for various kinds of uses in the hands of a child, and even can be used by adults as an object that can be tossed about. It can be carried easily since its casing is quite light and occupies very little space when deflated. Furthermore it takes very little time to inflate it and make it ready for use. The toy can be made of different sizes and configurations. It also can be used as an aquatic toy at beaches and swimming pools. When used as an aquatic toy it can serve either the purpose of helping a person to float on the water or it can be used as a toss for playing ball games and similar water activities. The toy has valves for allowing it to be inflated in a relatively short time and it can be deflated whenever it is desired to carry it or to transport the toy in a small space. The toy can be made from strong and tough material which will withstand abuse and keep its shape. The toy can be manufactured from inexpensive materials and thus be made available to a large number of people. The soft pliable material from which the toy is made prevents the child from causing harm with the toy. The toy cannot scratch furniture or walls.

The present invention is an inflatable nursery toy which generally includes shaped inner and outer inflatable bags composed of soft, limp, flexible, non-resilient sheet material such as a synthetic plastic, e.g. polyvinyl chloride, polyethylene, polypropylene, polystyrene, polyvinyl acetate or polyacrylonitrile. The inner bag is within the outer bag. The inner bag is elongated and has two opposite ends, and the inner bag extends from a first inner attachment at one end to a wall of the outer bag, to a second inner attachment at the opposite end to a wall of the outer bag. At least one discrete solid member, and typically a plurality of members, such as spherical hollow plastic balls, are provided and disposed within the inner bag, so that the member or members are displaceable by gravity along the length of the inner bag. In a preferred embodiment, similar discrete solid members, e.g. hollow plastic balls, are provided within the outer bag and external to the inner bag.

The outer bag has an opening in a wall thereof, to enable the outer bag of the toy to have air under mild pressure introduced into the interior thereof. Means is provided to selectively close this opening in the wall of the outer bag, in order to selectively retain air in the outer bag and thereby keep the toy inflated. The inflated toy has a configuration and dimensions such that when the toy is on a level horizontal surface, the top thereof is at approximately the level of the height of a hand of a small child learning to walk. The inflated toy has a curved surface, so that the inflated toy may be rolled by a small child over a level horizontal surface. The inner bag has an opening in a wall thereof, at the first and/or the second inner attachment to a wall of the outer bag, to enable the inner bag of the toy to have air under mild pressure introduced into the interior thereof, so that the inner bag assumes an elongated shape. Means is provided to selectively close this opening in the wall of the inner bag, in order to selectively retain air in the inner bag, and thereby permit motion of the discrete solid member or members along the axis of the elongated inner bag, when the toy is manipulated by being rolled by a small child over a level horizontal surface.

Typically the inflated outer bag is generally cylindrical; however, it could alternatively be spherical, oval or elliptical or the like. In most of these configurations, usually the inner bag extends from a first inner attachment at one end wall of the outer bag, to a second inner attachment to the other end wall of the outer bag. In general, and usually when the outer bag has an axis of symmetry, e.g. a central longitudinal axis, the axis of the inflated inner bag is at an angle to the axis of the inflated outer bag.

In a preferred embodiment, the inflated toy has the overall outer bag configuration of a barrel with closed outwardly bulging ends and an outwardly bulging side. In this case, the side wall is joined to the end walls at seams. Typically, the diameter of the inflated barrel is about ten inches, and such that when the toy is on its side, the top thereof is at approximately the level of the height of a hand of a small child learning to walk. In this preferred embodiment the toy further includes two toroids, i.e. a different one at each end of the barrel. Each toroid is usually composed of soft, limp, flexible, non-resilient sheet material around its rim and is joined to the barrel at the seam between a different end and the side of the barrel. The toroids are hollow and means is provided to connect the interiors of the toroids to the interior of the barrel, so that the toroids are inflated when the bag is inflated. The toroids have a cross-sectional diameter such that the toroids are adapted to be grapsed by the hand of a small child.

In most instances, the outer bag of the present invention is opaque and is provided with transparent windows of soft, limp, flexible, non-resilient sheet material. Typically the windows are equiangularly spaced around the outer bag, and are of approximately the same size. The windows are provided so that the child can see and observe the motion of the discrete solid members mentioned supra, within the inner bag and preferably also within the outer bag, as the toy is manipulated by rolling over a level surface as described supra, or otherwise.

The inflatable nursery toy of the present invention provides several salient advantages. Besides the advantages mentioned supra, the present inflatable nursery toy is highly useful in serving as a walking aid for a young child. The toy is light enough for a child to manipulate, but sturdy enough to support a child when it attempts to stand or to walk. The toy teaches a child, because the child can learn and observe the properties of gravity and equilibrium especially labile equilibrium, as the discrete solid elements, e.g. spheres, move back and forth within the inner bag as the toy is manipulated, i.e. rolled across a planar surface. The toy can be used in connection with water sports for young children, and as the plurality of discrete solid objects move about within the inner bag and also preferably within the outer bag, the toy generates sound when played with. The toy is useful for visually training children, e.g. the toy allows children to observe the motion of spheres when they are subjected to external forces, e.g. the force of gravity. The toy acquaints children with the transparent properties of windows, and/or the toy provides children with an analogue of a television screen. The toy teaches children the difference between a sphere and a cylinder, with respect to their physical shapes and also with respect to their rolling properties. Thus, the present toy is a light weight soft educational toy, which can be handled easily by children, and which can be safely thrown without harm. The toy is durable, rugged and resilient, and is resistant to abuse by the child, e.g. when it is thrown about. The child can observe both the inside and the outside of the toy, and can learn to distinguish the difference between stable and labile equilibrium. The toy contains, in its interesting interior, articles that can be observed through windows from the outside, together with the reaction to any forces and motion applied to the toy from the outside. Finally, the toy is interesting to a child, and can even be used as a seat for a child.

The invention accordingly consists in the features of construction, combination of elements, and arrangement of parts, which will be exemplified in the article of manufacture hereinafter described, and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
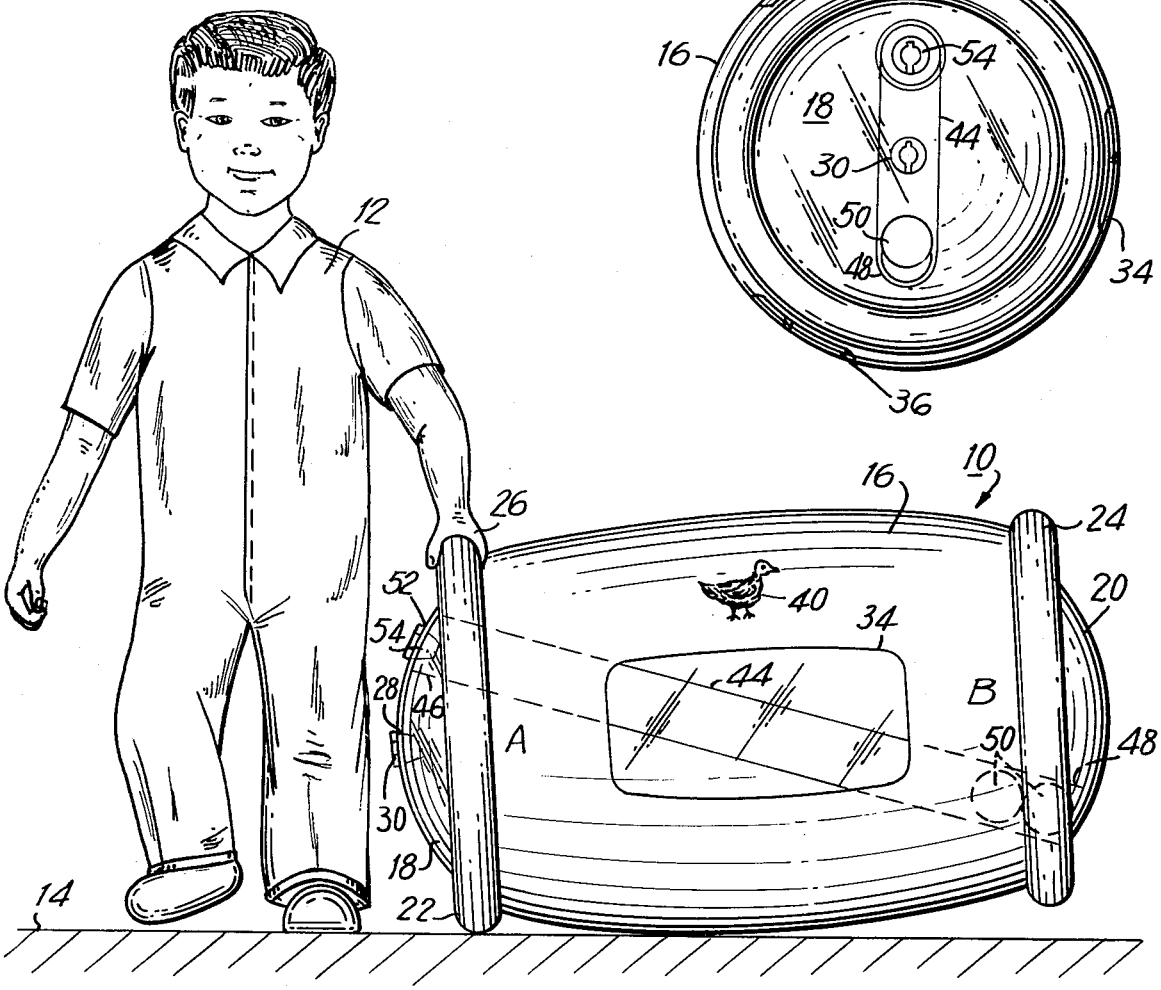
FIG. 1 is an elevation view of the present toy being played with, i.e. rolled about, by a small child.

Referring now to FIG. 1, the present inflatable nursery toy 10 is shown as it is being used as a walking aid by a child 12. The toy 10 rests and the child 12 stands on the flat planar horizontal surface 14, which may consist of the floor of a nursery or playroom. The toy includes an essentially cylindrical part 16 of barrel shape, i.e. somewhat bulging (outwardly convex), which constitutes the side wall of an outer inflatable bag composed of soft, limp, flexible, non-resilient sheet material. The end rims of this cylinder 16 are connected, as by heat and pressure welding, to end discs 18 and 20, with which it forms a fully enclosed volume of the outer bag. The end discs 18 and 20 constitute the opposite end walls of the outer inflatable bag. As mentioned supra, the cylinder 16 and the discs 18 and 20 are preferably formed of limp flexible thermoplastic sheet material, e.g. sheet polyvinyl chloride. The walls 16, 18 and 20 of the barrel-shaped outer bag preferably are made from a thermoplastic material in order to simplify manufacture. While a number of thermoplastic materials are available for this purpose, polyvinyl chloride is particularly suitable. Polyvinyl chloride at room temperature can only be dissolved by very few solvents. This is of particular advantage since contact with common liquids as they occur in a household will not damage the polyvinyl chloride sheeting. Another important property of polyvinyl chloride is its flame resistance caused by chlorine in the polyvinyl chloride chain. Thus there is little probability that inappropriate handling of the toy by a child might cause the toy to burn. The softness and pliability of the polyvinyl chloride is increased with plasticizers which give it the properties that are highly desirable for use as a child's toy. Furthermore the low price and the excellent properties of polyvinyl chloride make it very advantageous to use it as a structural material for a walking aid for a child.

At the junctions of the cylinder 16 with the discs 18 and 20, hollow toroids 22 and 24 are attached, as by heat and pressure welding. The toroids 22 and 24 are of a size, e.g. about one inch in cross-sectional diameter, which easily can be gripped by a hand 26 of the child 12. The diameter of the cylinder 16 is suitably sized to faciliate manual handling; a typical and preferred diameter being about ten inches.

As shown, the entire toy 10, e.g. the outer bag (walls 16, 18 and 20), and the toroids 22 and 24, are in the inflated condition. This has been accomplished by providing an opening 28 in the side wall 18, through which air (expelled human breath) under mild pressure has been introduced into the interior of the outer bag. Means, consisting in this embodiment of the invention of a detachable plug 30, or other suitable valve means, is provided to selectively close the opening 28, in order to selectively retain air in the outer bag and thereby keep the toy 10 inflated. Thus, the inflated toy has a configuration and dimensions such that when the toy 10 is on a level horizontal surface such as surface 14, the top thereof, i.e. the top of toroid 22, is at approximately the level of the height of the hand 26 of the small child 12 who is learning to walk. As shown, the inflated toy 10 has a curved surface (side wall 16), so that the inflated toy 10 may be rolled by the small child 12 over the level horizontal surface 14.

Figure 3:
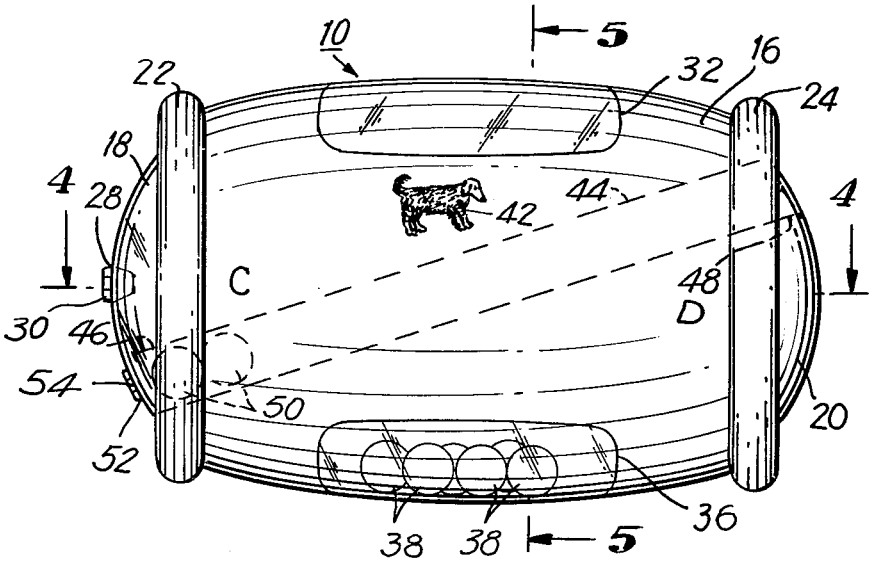
FIG. 3 is an elevation view of the toy of FIG. 1 when rotated by 180 degrees about its axis of symmetry, i.e. its central longitudinal axis.
Figure 4:
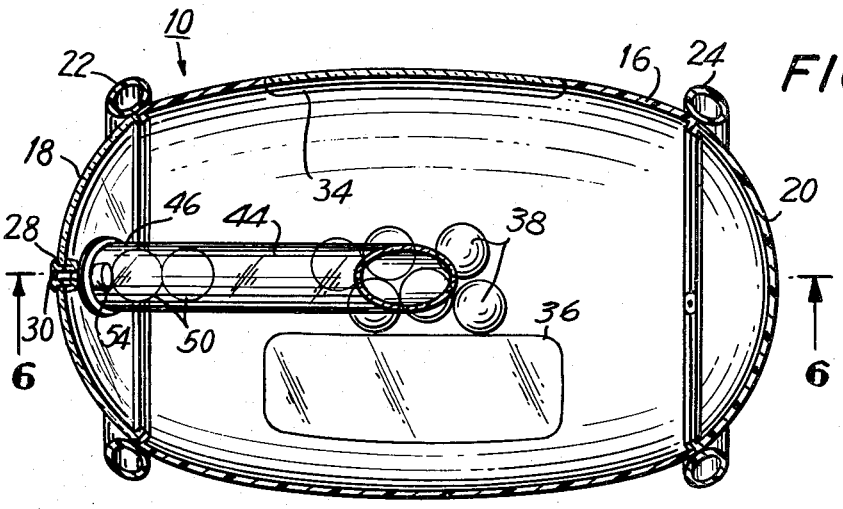
FIG. 4 is a sectional plan view taken substantially along the line 4—4 of FIG. 3.
Figure 5:
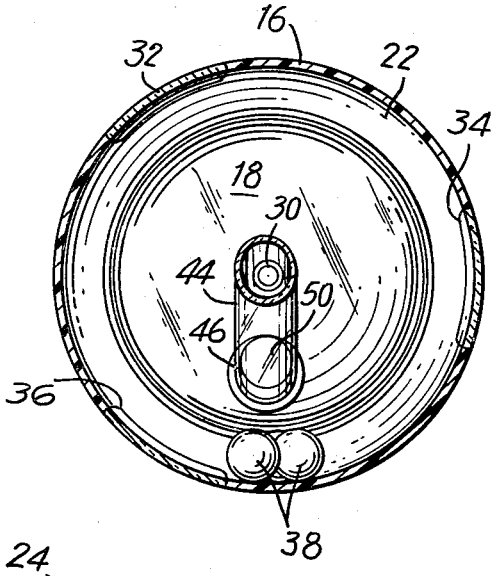
FIG. 5 is a sectional elevational view taken substantially along the line 5—5 of FIG. 3.

The outer bag is opaque and is provided with transparent windows 32, 34 and 36, and a plurality of discrete solid spheres 38, e.g. hollow plastic balls, may be seen through the windows, e.g. through windows 36 (FIG. 3). Cartoon representations such as animals with which the child can identify, e.g. bird 40 (FIG. 1) or dog 42 (FIG. 3) are provided on the surface of side wall 16; letters or other indicia may also be provided (See A, B in FIG. 1 and C, D in FIG. 3).

Figure 2:
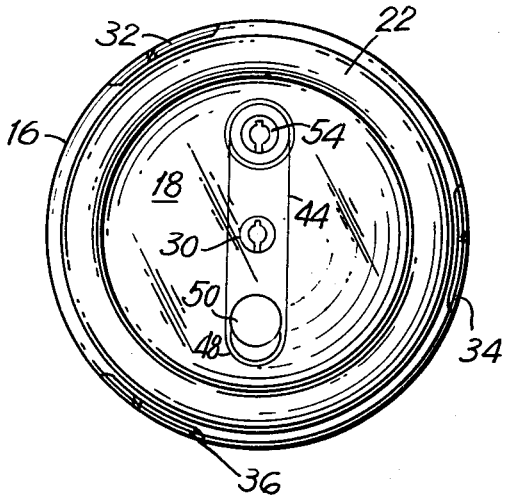
FIG. 2 is an elevation view of one end of the present toy, namely, the toy end in which the valves are provided in the end wall.

In accordance with the present invention, an inner elongated inflatable bag 44 is provided within the outer bag, i.e., within the walls 16, 18 and 20. The inner bag 44 is typically composed of soft, limp, flexible, non-resilient sheet material comparable to that of walls 16, 18 and 20 described supra. As shown in the inflated condition, the inner bag 44 is elongated, e.g. generally rectilinear, and has two opposite ends 46 and 48. The inner bag 44 extends from a first inner attachment at the end 46 to the wall 18 of the outer bag, to a second inner attachment at the opposite end 48 to the wall 20 of the outer bag. A plurality of hollow spherical plastic balls 50 constituting discrete solid members are disposed within the inner bag, so that the members 50 are displaceable along the length of the inner bag 44 under the influence of gravity, i.e. the balls 50 roll along from side to side or end to end within the inner bag 44, when the toy 10 is rolled by the child 12. As shown, the balls 50 are adjacent end 48 in FIGS. 1 and 2, and adjacent end 46 in the balance of the FIGS. In other words, the balls roll toward whichever end of the inner bag 44 is lower; the axis of symmetry or central longitudinal axis of the inner bag 44 is at an acute angle to the respective axis of the outer bag, as shown.

The inner bag 44 has an opening 52 at its junction with and attachment to wall 18 at end 46, to enable the inner bag 44 of the toy to have air, e.g. expelled human breath, under mild pressure, introduced into the interior thereof, so that the inner bag 44 assumes an elongated, and in this case a generally rectilinear shape. Means consisting of a plug 54 is provided to selectively close the opening in the wall of the inner bag, in order to selectively retain air in the inner bag 44 and thereby permit motion of the discrete hollow plastic balls 50 along the axis of the elongated inner bag 44 when the toy 10 is rolled by the child 12 over the level horizontal surface 14.

Figure 6:
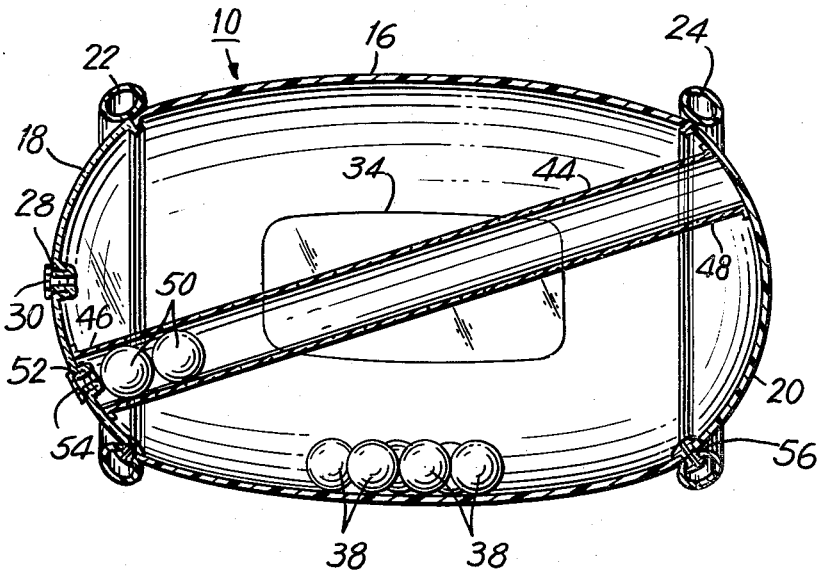
FIG. 6 is a sectional elevation view taken substantially along the line 6—6 of FIG. 4.

Finally, it should be noted that means such as passage 56 (FIG. 6) is provided to connect the interiors of the toroids, in this case toroid 24, to the interior of the barrel-shaped outer bag, so that the toroids are inflated when the bag is inflated.

It thus will be seen that there is provided an article of manufacture consisting of an inflatable nursery toy which achieves the various objects of the invention and which is well adapted to meet the conditions of practical use.

As various possible embodiments might be made of the above invention, and as various changes might be made in the embodiment above set forh, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. An inflatable nursery toy comprising shaped inner and outer inflatable bags composed of soft, limp, flexible, non-resilent sheet material, said inner bag being within said outer bag, said inner bag being elongated and having two opposite ends, said inner bag extending from a first inner attachment at one end to a wall of said outer bag, to a second inner attachment at the opposite end to a wall of said outer bag, at least one discrete solid member, said member being disposed within said inner bag so that said member is displaceable by gravity along the length of said inner bag, said outer bag having an opening in a wall thereof to enable the outer bag of the toy to have air under mild pressure introduced into the interior thereof, means to selectively close said opening in the wall of the outer bag in order to selectively retain air in the outer bag and thereby keep the toy inflated, said inflated toy having a configuration and dimensions such that when the toy is on a level horizontal surface, the top thereof is at approximately the level of the height of a hand of a small child learning to walk, said inflated toy having a curved surface so that said inflated toy may be rolled by a small child over a level horizontal surface, said inner bag having an opening in a wall thereof at said first and/or second inner attachment to a wall of said outer bag, to enable the inner bag of the toy to have air under mild pressure introduced into the interior thereof so that said inner bag assumes an elongated shape, and means to selectively close said opening in the wall of the inner bag in order to selectively retain air in the inner bag and thereby permit motion of said discrete solid member along the axis of said elongated inner bag when the toy is manipulated by said rolling by a small child over a level horizontal surface.

2. The inflatable nursery toy of claim 1 in which a plurality of discrete solid members are provided within the inner bag.

3. The inflatable nursery toy of claim 1 in which the discrete solid member is spherical.

4. The inflatable nursery toy of claim 1 in which at least one discrete solid member is provided within the outer bag and external to the inner bag.

5. The inflatable nursery toy of claim 4 in which the discrete solid member is spherical.

6. The inflatable nursery toy of claim 4 in which a plurality of discrete solid members are provided within the outer bag and external to the inner bag.

7. The inflatable nursery toy of claim 1 in which the inflated outer bag is substantially cylindrical.

8. The inflatable nursery toy of claim 7 in which the inner bag extends from a first inner attachment to one end wall of the outer bag to a second inner attachment to the other end wall of the outer bag.

9. The inflatable nursery toy of claim 8 in which the axis of the inflated inner bag is at an angle to the axis of the inflated outer bag.

10. The inflatable nursery toy of claim 1 in which the inflated inner bag is substantially cylindrical.

11. The inflatable nursery toy of claim 1 in which the inflated toy has the overall outer bag configuration of a barrel with closed outwardly bulging ends and an outwardly bulging side, said side being joined to said ends at seams, the diameter of the inflated barrel being about 10" and such that when the toy is on its side the top thereof is at approximately the level of the height of a hand of a small child learning to walk, said toy further including two toroids, a different one at each end of the barrel, each toroid being of soft, limp, flexible non-resilient sheet material around its rim and joined to the barrel at the seam between a different end and said side, said toroids being hollow, and means connecting the interiors of the toroids to the interior of the barrel so that the toroids are inflated when the bag is inflated, the toroids having a cross-sectional diameter such that the toroids are adapted to be grasped by the hand of a small child.

12. The inflatable nursery toy of claim 1 in which the inner and outer bags are composed of a synthetic plastic selected from the group consisting of polyvinyl chloride, polyethylene, polypropylene, polystyrene, polyvinyl acetate and polyacrylonitrile.

13. The inflatable nursery toy of claim 1 in which the outer bag is opaque and is provided with transparent windows of soft, limp, flexible, non-resilient sheet material.

14. The inflatable nursery toy of claim 13 in which the windows ae equiangularly spaced around the outer bag and are of approximately the same size.

15. An inflatable nursery toy comprising an outer tubular member composed of soft limp flexible non-resilient sheet material, said outer tubular member having opposite closed ends so that said outer tubular member defines an enclosed volume, an inner tubular member, said inner member being located within said outer member, means closing opposite ends of said inner member so that said inner member defines an enclosed volume, one end of said inner member being located at one end of said outer member and the other end of said inner member being located at the other end of said outer member, means securing the ends of the inner member to the ends of said outer member, said inner member being so oriented with respect to said outer member that when the axis of symmetry of said outer member is horizontal and the outer member is rolled along a horizontal surface, the ends of said inner member will successively be oppositely raised and lowered, at least one object within said inner member, said object sliding in opposite direction along the length of the inner member as the outer member is rolled along a horizontal surface, means to introduce air into the outer member so as to inflate the same, and means to introduce air into the inner member so as to inflate the same.

* * * * *